US008730063B1

(12) United States Patent
Souther

(10) Patent No.: US 8,730,063 B1
(45) Date of Patent: May 20, 2014

(54) FAIL SAFE CONTROL CIRCUIT FOR A VEHICLE BARRIER SECURITY SYSTEM

(75) Inventor: Gary Lee Souther, Gainesville, GA (US)

(73) Assignee: SecureUSA, Inc., Cumming, GA (US)

( * ) Notice: Subject to any disclaimer, the term of this patent is extended or adjusted under 35 U.S.C. 154(b) by 306 days.

(21) Appl. No.: 13/169,442

(22) Filed: Jun. 27, 2011

(51) Int. Cl.
*G08G 1/01* (2006.01)

(52) U.S. Cl.
USPC ..... 340/933; 340/943; 404/6; 404/15; 404/72

(58) Field of Classification Search
USPC ..... 404/6, 15, 72; 49/49
See application file for complete search history.

(56) References Cited

U.S. PATENT DOCUMENTS

2007/0146163 A1* 6/2007 Annoni et al. ..... 340/932.2
2009/0022546 A1* 1/2009 Rastegar et al. ..... 404/6

OTHER PUBLICATIONS

SecureUSA, Inc. press release dated Jun. 30, 2008 entitled "SecureUSA Develops Safety Module to Eliminate Accidental Destruction of Vehicles by Hydraulic Barriers and Bollards". pp. 1-2.

* cited by examiner

*Primary Examiner* — Tai T Nguyen
*Assistant Examiner* — Ojiako Nwugo
(74) *Attorney, Agent, or Firm* — Hope Baldauff, LLC

(57) ABSTRACT

A fail-safe circuitry for a vehicle barrier security system prevents accidental raising of the barrier due to inadvertent closing of an activation relay causing power to be provided to an activation mechanism raising the barrier. A latching relay, having a latched state and reset state, is placed in series between the activation relay and the activation mechanism. The latching relay is reset whenever the OPEN switch is pressed for lowering the barrier or an automatic reset relay is energized by a controller whenever passage of a vehicle is sensed. Prior to raising the barrier, the latching relay must be reset, which can occur by pressing the OPEN switch or by the controller detecting passage of a prior vehicle and activating a automatic reset relay. Accidental raising of the barrier due to malfunctions of the activation relay due to vibrations is prevented by latching and resetting the latching relay.

20 Claims, 6 Drawing Sheets

FAIL SAFE CONTROL CIRCUIT FOR A VEHICLE BARRIER SECURITY SYSTEM

BACKGROUND

Vehicle barrier security systems ("VBS systems") are commonly used to control passage of vehicles at entry points ("checkpoints") to buildings, facilities, or other locations. VBS systems are quite common at military installations, airports, government buildings, industrial plants, etc. A VBS system typically comprises a movable mechanical barrier designed to stop an unauthorized automobile, truck, or other vehicle from passing through a checkpoint. Typically, a security guard or an automated mechanism (e.g., card reader) is employed to control movement of the barrier. For VBS systems that are designed to prevent a vehicle from deliberate forced entry, the barrier is typically a massive steel or concrete structure able to withstand a head-on crash attempt. The barrier can comprise a steel bar, pipe, gate, or other suitable structure. Another common arrangement for the barrier comprises a series of relatively short vertical columns, called bollards, that rise from the road about three to four feet high at the checkpoint. Another common structure comprises a metal plate positioned across the road which angles up from the checkpoint. In the lowered position, the metal plate lies flat on the road. In the raised position, the metal plate angles up, about two feet. When the barrier is raised, this is referred to as the "closed" position (because the entry way is closed). When the barrier is lowered, this is referred to as the "open" position. These barrier structures are typically actuated upon command by a guard or an automated system to retract to allow or prohibit passage of a vehicle as appropriate.

The barriers are typically massive and heavy, and thus require a lift system that may include electric motors, hydraulic pumps, gear assemblies, etc., to raise and lower the barrier. These components are typically controlled by a controller comprising a microprocessor control system along with other electronic sensing and switching controls. These components may be housed in a stand-alone utility housing, guardhouse, or sentry station. The control system typically has a manual control in the form of a push switch to close the barrier (i.e., raise up the barrier). Such systems should be reliable, since a malfunction can cause the barrier to remain open (thus allowing unauthorized vehicles to enter) or remain closed (thus preventing authorized vehicles to enter). Other types of malfunctions include the barrier raising/lowering unexpectedly. These types of failures can cause damage or injury. Specifically, if the barrier raises when a vehicle is present at the checkpoint, or the barrier unexpectedly moves during servicing by a technician, then damage to the vehicle or injury to the technician can occur.

It is with respect to these and other considerations that the disclosure herein is presented.

SUMMARY

In one embodiment disclosed herein, a vehicle barrier security system ("VBS system") is provided for controlling a barrier at a security checkpoint. The VBS system includes a power source, a CLOSE switch, a vehicle detection relay, an actuation relay, a latching relay, an actuation mechanism, and an automatic reset relay. The CLOSE switch connects to the power source and provides power from the power source to raise the barrier when activated. The vehicle detection relay receives the power from the CLOSE switch at a first contact of the vehicle detection relay and provides the power to a second contact of the vehicle detection relay when a vehicle is not detected at the checkpoint. The actuation relay includes an actuation relay coil and receives the power from the second contact of the vehicle detection relay to energize the actuation relay coil. Power at a first contact of the actuation relay is provided to a second contact of the actuation relay. A latching relay having a latched state and a reset state is connected in series with the actuation relay. The latching relay receives the power from the second contact of the actuation relay at a first contact of the latching relay, and provides the power to a second contact of the latching relay when the latching relay is in the reset state. The actuation mechanism is configured to raise the barrier. The VBS system raises the barrier when the actuation relay provides the power to the second contact of the actuation relay, when the latching relay is in the reset state, and when the power is provided to the second contact of the latching relay thereby providing power to the actuation mechanism. After the vehicle is detected as passing through the checkpoint, the automatic reset relay is energized providing power from a first contact to a second contact of the automatic reset relay, thereby providing power to a reset coil of the latching relay and resetting the latching relay.

In another embodiment disclosed herein, a VBS system is provided for controlling positioning of a barrier at a checkpoint in a vehicle barrier control system that includes: a power source, an input switch configured to be activated by a user thereby generating a signal to raise the barrier, and an actuation mechanism configured to raise or lower the barrier when receiving power to raise the barrier. The VBS also includes a vehicle sensor detecting the presence of a vehicle at a checkpoint, a controller generating a second signal indicating the presence of the vehicle detected by the vehicle sensor, a first switch in a normally closed state and configured to be opened when receiving the second signal indicating the presence of the vehicle, and a second switch in a normally opened state and configured to be closed when the input switch generates the signal to raise the barrier. The VBS also includes a latching switch having a reset state wherein the latching switch is closed, the latching switch also having a latched state wherein the latching switch is open. The input switch and the first switch are connected in series to provide the signal to the second switch, thereby providing power from the power source through both the second switch and the latching switch to the actuation mechanism to raise the barrier when: the input switch generates the signal to raise the barrier, there is no second signal indicating the presence of the vehicle detected by the vehicle sensor, and the latching switch is reset. An automatic reset relay is configured to receive a third signal from the controller generating the third signal indicating the passage of the vehicle by a second vehicle sensor, thereby providing power to place the latching switch in a reset state.

In another embodiment disclosed herein, a method of controlling movement of a barrier in a vehicle barrier security system is described, the method comprising the operations of: detecting passage of a vehicle past a checkpoint, generating a signal to an automatic reset relay thereby causing power to be provided to a latching switch and placing the latching switch into a reset state. The operations also include receiving input from a user at a switch for raising the barrier at the checkpoint thereby generating a first signal, receiving a second signal at a second switch in a normally closed state, wherein the second signal indicates the absence of a vehicle over the barrier. Then, the first signal is received at a third switch in a normally open state thereby closing the third switch, and provides power from a power source through the third switch in response to closing the third switch. When the third switch is closed, this causes power to be provided from the third switch to a latching switch, wherein the latching switch is a normally closed switch in the reset state the latching switch is in the reset state, and results in providing the power from the latching switch to an actuation mechanism causing the barrier to raise.

In another embodiment disclosed herein, a computer readable medium storage device comprises instructions, which when executed by a computer cause the computer to receive input from a user requesting to open a barrier at a checkpoint and ascertain that the user is authorized to pass the checkpoint. Further, signals are received indicating that no vehicle is presently located over or under the barrier, and the computer then provides a signal to an activation switch, thereby closing the activation switch. This causes power to be provided through the activation switch, which in turn causes a latching switch to reset, and putting the latching switch in a closed state. This, in turn, causes power to be provided from the latching switch to an actuation mechanism causing the barrier to move, so as to allow entry of the vehicle. Finally, the passage of the vehicle past the barrier at the checkpoint is detected, and a signal is generated to the latching switch in response to detecting the passage of the vehicle, wherein the latching switch is reset to a normally closed state.

The features, functions, and advantages that have been discussed can be achieved independently in various embodiments of the present disclosure or may be combined in yet other embodiments, further details of which can be seen with reference to the following description and drawings.

This Summary is provided to introduce a selection of concepts in a simplified form that are further described below in the Detailed Description. This Summary is not intended to identify key features or essential features of the claimed subject matter, nor is it intended that this Summary be used to limit the scope of the claimed subject matter. Furthermore, the claimed subject matter is not limited to implementations that solve any or all disadvantages noted in any part of this disclosure.

DETAILED DESCRIPTION

Figure 1:
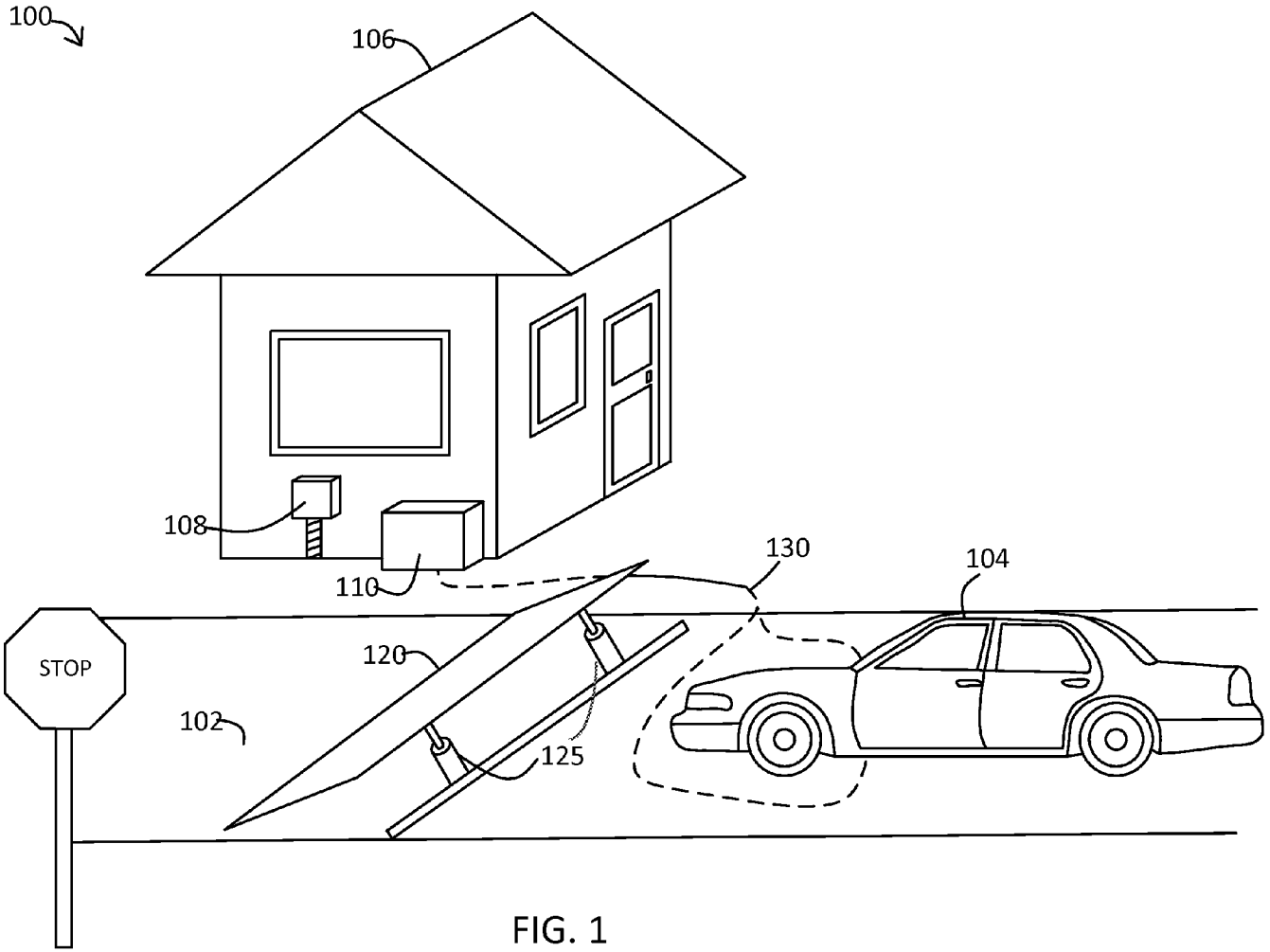
FIG. 1 illustrates one embodiment of various components in a vehicle barrier security system according to various embodiments described herein.

Various embodiments of the present disclosure describe a vehicle barrier security system ("VBS systems") that includes a movable barrier capable of stopping or blocking entry of a vehicle at a checkpoint. Although various embodiments are described in the context of movable barrier security systems, it should be recognized that application of the disclosure is not limited to the particular components illustrated or to vehicle oriented security systems. In the following detailed description, references are made to the accompanying drawings by way of illustration and various embodiments of the disclosure. In the drawings, like numerals represent like elements.

An embodiment of the VBS is shown in FIG. 1, which illustrates a context of how the various components in a VBS are installed. In FIG. 1, the environment 100 typically comprises a vehicle entry point where a road 102 terminates at the entry point for a vehicle 104 to a facility or building. In this embodiment, a guardhouse 106 is present, which may house a control system 108, and various lift system components 110. In conventional systems, the control system 108 may employ a printed circuit board ("PCB") as a control panel mounted within the enclosure. However, the PCB can be subject to vibration, movement, and other stresses. Although these components could also be remotely located, typically they are located near the entry point. Separate or common enclosures for the control system and lift system components may be used. Typically, these enclosures are located within the guardhouse 106, attached to a structure, or external (free standing). In other embodiments, underground enclosures can be used.

The barrier 120 in this embodiment is shown as a rising barrier plate, in the closed position. In one embodiment, the barrier is hinged on one side and is lifted by one or more actuation mechanisms. The actuation mechanism can be of powered by various hydraulic, electrical, and/or mechanical arrangements. This may involve motorized pulley arrangements, hydraulically operated pistons, directional valves, electrical or hydraulic gear assemblies, including screw-drive actuators. In FIG. 1, one embodiment illustrated is based on a plurality of hydraulic piston lifts 125. It should be recognized that the exact form of lifting mechanism is not relevant to practicing the principles of the present invention and a variety of types can be used. Hydraulic fluid under pressure causes the two pistons 125 to lift one side of the barrier. The non-hinged side rises, and presents a barrier to on-coming vehicles. In some instances, the barrier 120 is made of steel or other metal capable of stopping a speeding vehicle. Consequently, significant force may be required to lift the plate. In other embodiments, bollards, pipes, arms, or other barriers could be erected, raised, or otherwise placed into position. The exact form of the barrier is not relevant to practicing the principles of the present invention.

A sensor wire 130 may be buried in the road 102 for detecting the presence of a vehicle 104 and the wire is connected to a controller. These sensors operate by detecting a change in the surrounding capacitance or inductance caused by the presence of a vehicle, which is detected by the controller in the control panel 108. Other types of sensors can be used, including optical beams, digital cameras, ultrasound, infra-red, etc. The sensor can be used in conjunction with the controller as a safety mechanism, so that the barrier is not raised when a vehicle 104 is located over the barrier 120. Accidental raising of the barrier can cause unintended damage to vehicles.

For example, VBS systems are often used at petrochemical plants, where tanker trunks regularly pass through a checkpoint. Accidentally raising a barrier (i.e., closing the barrier) when a tanker truck is in the checkpoint (such as when driving over the barrier) can cause damage to the tanker truck, leading to damage, and in a worst case scenarios, cause leaking of the tanker contents. Thus, VBS systems may employ a vehicle presence sensor that can be used in preventing closing the barrier when a vehicle is present.

In many installations, a large tractor trailer passing through the checkpoint can cause vibrations to the adjacent ground, due to the weight of the vehicle, especially when fully loaded.

These vibrations can be transferred to the control panel. Typically, in prior art systems, the control panel is a printed circuit board attached to a structure, or to metal or concrete mounting structures attached to the ground that provides a path for vibrations to pass. Vibrations to the printed circuit board can accidentally cause various relays mounted on a control panel board to make (or break) contact. As will be seen, the relays control the raising or lowering of the barrier, and the vibrations or other types of errors can accidentally cause the barrier to be raised. In other installations, high winds, minor earthquake tremors, or other forces can similarly result in vibration to the control panel. These forces can be transferred to the printed circuit board, causing movement of the components and stressing lead connectors on the board, thus adversely impacting the connectivity between components therein.

Figure 2:
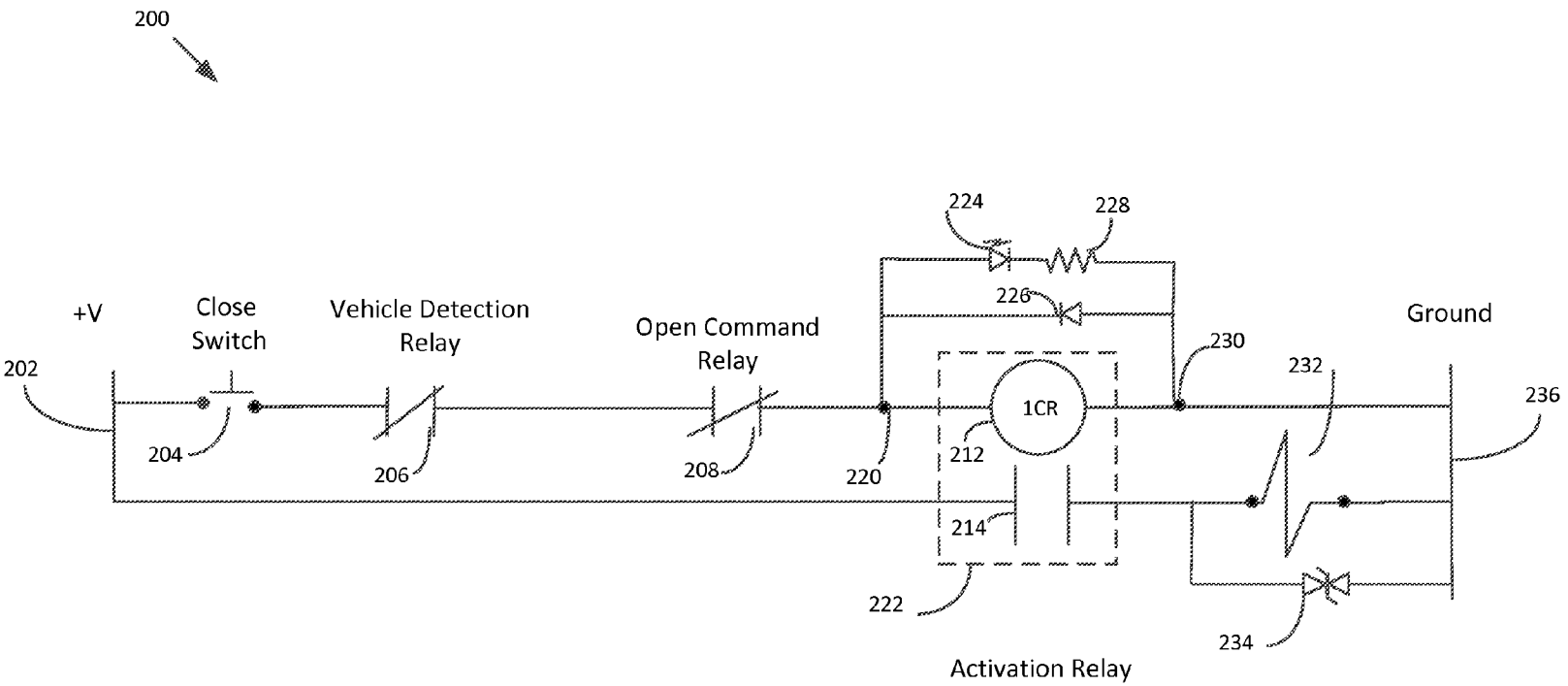
FIG. 2 PRIOR ART
FIG. 2 illustrates one embodiment of a prior art system for controlling a barrier in a vehicle barrier security system.

One prior art control system for a VBS is shown in FIG. 2. In this control system a positive voltage V+ 202 is provided along with a ground 236. The supply voltage between +V and ground could provide a total potential of 24 volts. Other embodiments may use different voltages, or voltage potential arrangements. A CLOSE switch 204 is manually activated by the security guard (or can be activated by an automated system) in order to raise the barrier and close passage on the road. Pressing the CLOSE switch causes supply power V+ (hereinafter simply "power") to be provided to the next element, which is relay 206.

Relays are mechanical devices, where a coil acting as a solenoid moves an armature, which is essentially a switch, to make (or break) contact between a pair of switch contacts (herein simply "contacts"). Relay 206 is referred to as the vehicle detection relay, because it is energized when a vehicle is present at the checkpoint. Relay 206 is normally closed, meaning that in the absence of the coil being energized, the relay contacts are closed—e.g., a circuit is completed. In the depiction of FIG. 2, the coil portion of the relay 206 is not shown, but those skilled in the art will readily comprehend the operation of the circuit. How the coil itself is activated by the control panel sensing a vehicle is outside the scope of the present disclosure.

Another relay in series is provided—the Open Command relay 208 since it is open only when a command to open (lower) the barrier is provided by pressing the OPEN switch (not shown). Once the coil of the Open Command relay 208 is energized, then the contacts separate, and an open circuit condition exists. Thus, issuing a command to lower the barrier prevents the simultaneous raising of the barrier. It is assumed that when the CLOSE switch is being pressed, the Open Command relay is not energized.

To summarize, the state of vehicle detection relay 206 is normally closed, unless a vehicle is present. Once a vehicle is present, then the relay creates an open circuit. The detection is performed by other circuitry in the control panel, using one of the aforementioned techniques. Thus, if a vehicle is present at the checkpoint, the barrier cannot be raised because of the open circuit condition, even if the security guard activates the barrier by pressing the CLOSE switch.

Assuming that a vehicle is not present, and the vehicle detection relay 206 is closed, then power is provided to relay 208 when the CLOSE switch is pressed. Relay 208 is in the normally closed state, and is opened only when the OPEN command is provided. Since the action taken is pressing the CLOSE switch (and not the OPEN switch), relay 208 remains closed. If the OPEN switch were pressed simultaneously with the CLOSE switch, then relay 208 would be open, and the CLOSE switch would not raise the barrier.

Assuming relay 208 is closed, power is then provided to the activation relay 222, which is depicted with both its coil 212 (designated as 1CR), and switching contacts 214. In this diagram, the switching contacts 214 are normally open, meaning that if the coil 212 is not energized, then contacts 214 are open. The contacts 214 switch power from the voltage source V+ 202 to the actuation mechanism, which in this illustration is a directional valve 232, which provides provide hydraulic power to lift the barrier.

The directional valve is a solenoid itself that shifts a valve into one of two positions, which serves to direct hydraulic fluid to either raise or lower the barrier. Although a directional valve is shown, other arrangements are known to those skilled in the art for receiving a signal and causing the barrier to be raised or lowered. Thus, a variety of actuation mechanisms can be used in applying the principles of the present invention.

Other components shown in FIG. 2 include an LED 224 and current limiting resistor 228. These provide a visual indication that the relay 222 is energized and that the barrier is closing. Diodes 226 and 234 provide overvoltage protection from voltage spikes that may be present due to the coil being energized/de-energized.

In summary, activating the CLOSE switch 204 provides power to the activation relay 222 if there is no vehicle present and no OPEN command signal is received. Once power is provided to the coil 212, the contacts 214 close and provide power to the directional valve 232. However, it is possible that contacts 214 of the activation relay 222 can close without power being provided to the coil 212 due to, e.g., vibration or other forces. If the contacts 214 close, the directional valve is activated regardless of the state of the CLOSE switch and the vehicle detector and the barrier will rise. This is because power from the voltage source +V 202 is always present on one of the contacts 214. The contacts may close due to the aforementioned vibration at the control panel. The vibrations generated by the truck can be transmitted through conduit carrying electrical wires and hydraulic lines, or the ground itself, back to the control panel. The vibrations can cause the relay contacts 214 to inadvertently contact and raise the barrier. Thus, the passing of a truck over the barrier can lead to the barrier rising under the truck, causing significant damage. Accidental contact may also happen more frequently as the relays age.

Figure 3:
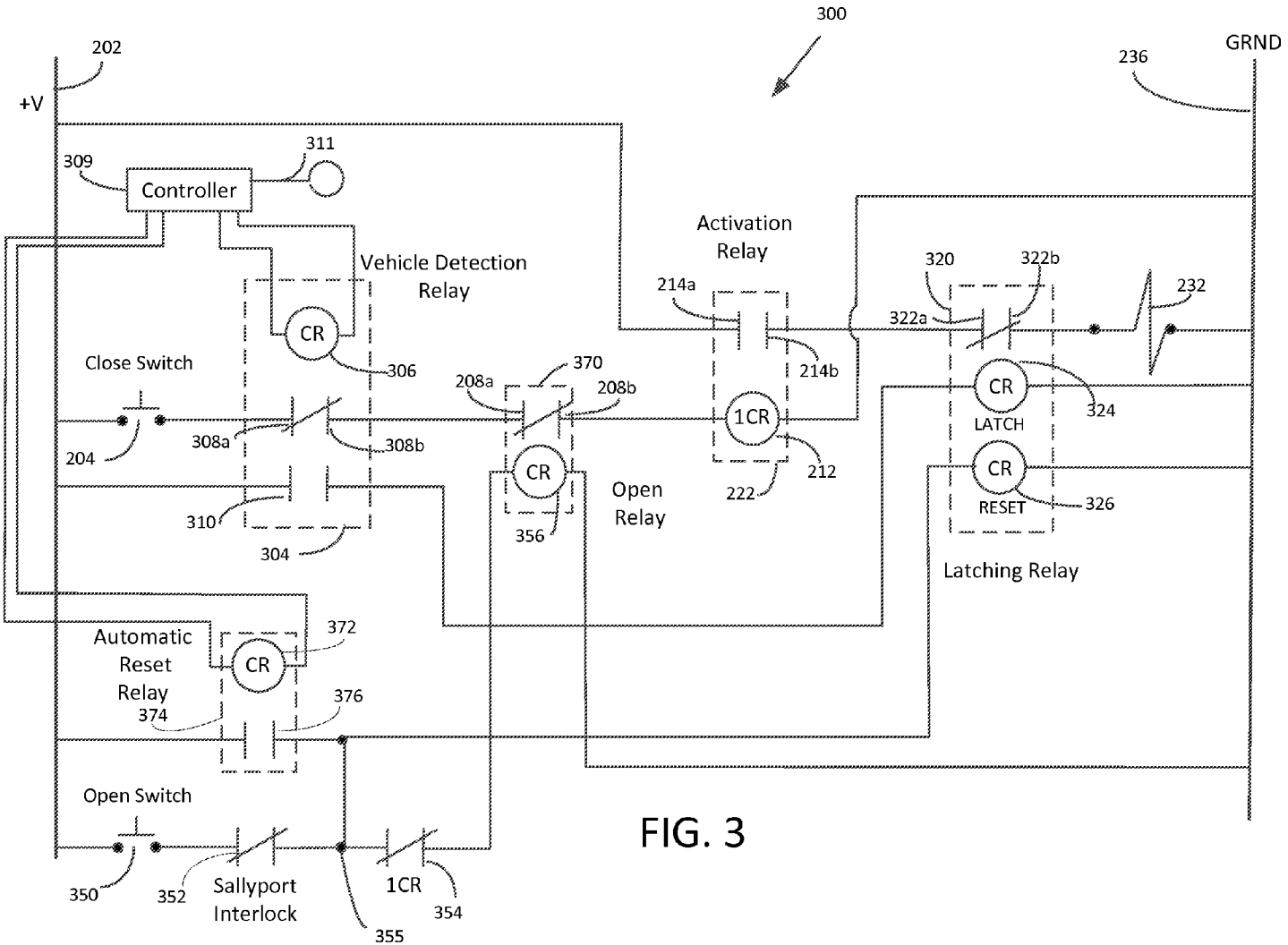
FIG. 3 illustrates one embodiment of a fail-safe control system for controlling a barrier in a vehicle barrier security system according to various embodiments described herein.

One embodiment incorporating additional safety features is shown in FIG. 3. The system 300 of FIG. 3 illustrates one approach that involves modification to FIG. 2 to the form of the vehicle detection relay 304 as shown in FIG. 3, adding a latching relay 320 in series with the directional valve 232, and an automatic reset relay 374. A latching relay is a relay that retains its state after the relay has been activated. In other words, if the coil is energized to create an open circuit at the switch contacts, the open circuit will remain after the coil is no longer energized. Similarly, if the coil is energized to close a circuit, the circuit will remain closed after the coil is no longer energized. In FIG. 3, the latching relay 320 comprises a set (e.g., a pair) of normally closed contacts 322 comprising a first contact and a second contact, and two distinct coils, namely a latch coil 324 and a reset coil 326. The latching relay 320, when reset, causes the contacts 322 to go into the closed state (e.g., create a closed circuit). This is referred to as the "latched state." Only when the latch coil 324 is energized are the switch contacts 322 then opened and the latched relay is considered to be in the latching state. When the reset coil 326 is energized, the switch contacts are closed, and this is referred to as the "reset state." Although this latching relay is shown as having two coils, other forms of the latching relay may be used, including latching relays having a single coil, and that are operated (e.g., latched or reset) by providing a different number of pulses.

The vehicle detection relay 304 is a double-pole relay, meaning there are two sets of switch contacts 308, 310. Each set of contacts comprises two contacts (a first contact 308*a* and a second contact 308*b*, collectively referred to as contacts 308). Switch contacts 308 are normally closed, and the other set of switch contacts 310 is normally open. A single coil 306 is energized when a vehicle is detected, and throws both sets of switching contacts 308, 310. Because one set of contacts 308 is normally closed, and the other contacts 310 are normally opened, only one set of contacts is ever in the opened or closed state. The coil 306 is operated by a controller 309, which sends a signal to the vehicle detection relay when a vehicle is detected by the in-ground sensor wire 311. There may be multiple sensor wires 311 to detect vehicles in different locations relative to the barrier. For example, a sensor wire may detect passage of the vehicle past the barrier.

To operate the barrier in this configuration, the operator must first reset the latching relay by activating the OPEN switch 350. Thus, even if the barrier is already in the down (open) position, the operator must press the OPEN switch after the barrier is lowered in order to raise it. Thus, the operator may press the OPEN switch twice. When the OPEN switch is pressed for a second time, this resets the latching relay, and the barrier can then be raised by pressing the CLOSE switch. Thus, it is not possible to accidentally raise the barrier merely by pressing the CLOSE switch after the barrier is dropped. A deliberate resetting and activation of the latching relay must occur. Further, because the latching relay 320 is placed in series with the directional valve 232, any vibration closing the contacts of the activation relay 222 does not provide power to the directional valve 232 unless the latching relay 320 is reset.

Once the vehicle passes through the checkpoint, the reset coil 326 can be energized to reset the latching relay 320 in one of two ways. First, as indicated above, the operator can manually activate the OPEN switch 350. Providing the sallyport interlock switch 352 is closed, power from the voltage source 202 is provided to the reset coil 326. Alternatively, an automatic reset relay 374 can be added that provides a parallel path for power to be provided from the voltage source 202 to the reset coil 326. Specifically, the coil 372 of the automatic reset relay 374 is energized by the controller 309 after the vehicle passes the checkpoint, and is clear of the barrier. The controller may have a plurality of sensors 311 for detecting vehicles when they approach the checkpoint, when they are in the checkpoint, and when they pass after the checkpoint.

In one embodiment, the components shown in FIG. 3 can be mounted on a weather- tight enclosure itself, or in some other secured manner, as opposed to mounting the components first on a printed circuit board, and then mounting the printed circuit board to the enclosure. The mounting arrangement of a typical circuit board using standoffs can amplify vibrations to the components mounted to the printed circuit board, thereby causing intermittent faults after time. Mounting the components in a secure manner to the enclosure can mitigate vibrations and other stresses. For example, rather than mounting on the larger components on a circuit board, the components such as relays, connectors, etc. can be mounted on the cabinet. In another embodiment, the relay components can be mounted separately from other components which may generate vibrations, including motor starters. Although this may necessitate using separate cables or wires to interconnect the components, doing so can provide more reliability than if all the components are mounted on a common printed circuit board and the wires have increased current capacity relative to PCB leads.

Figure 4:
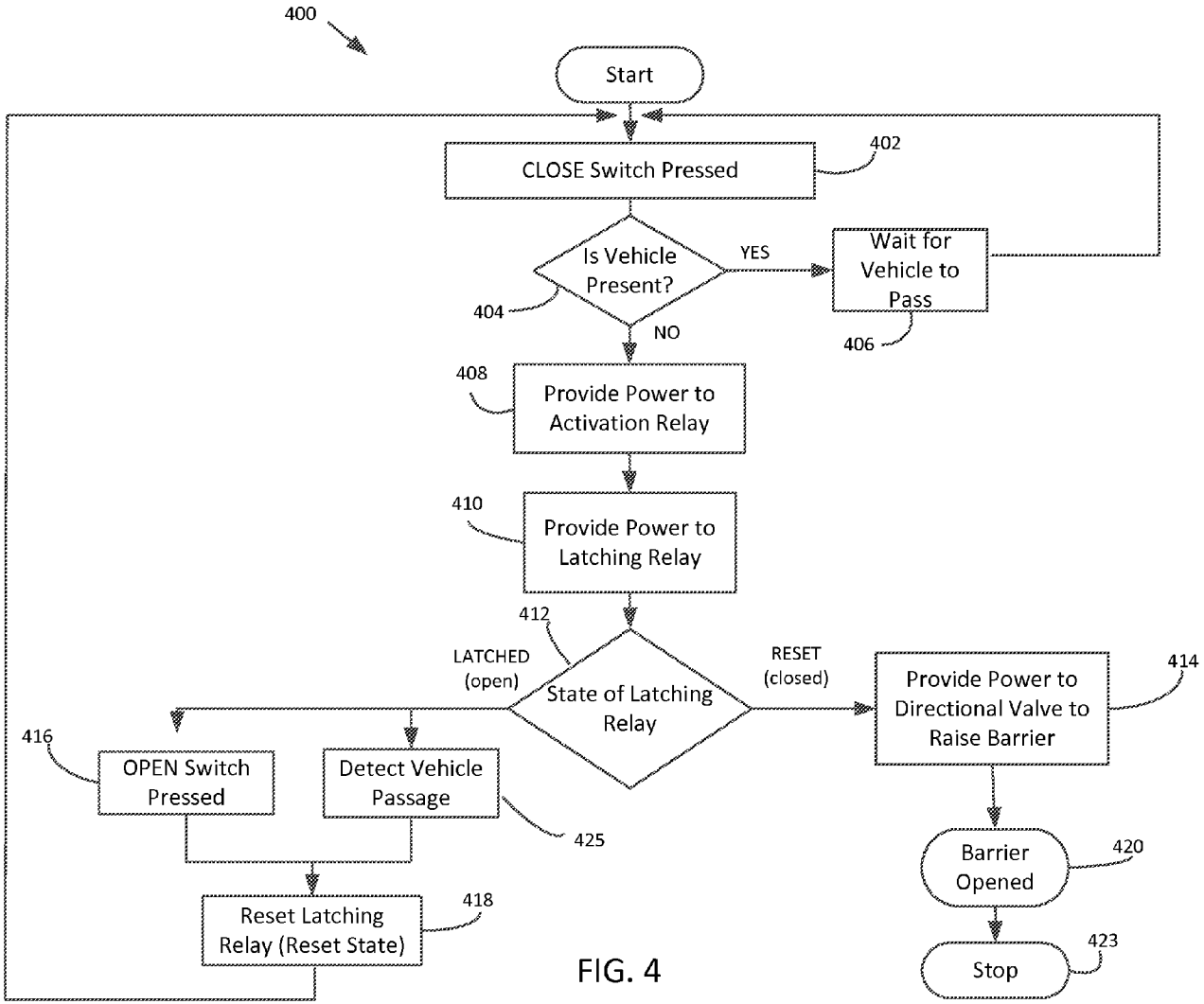
FIG. 4 illustrates one method illustrating operation of the control system according to various embodiments described herein.

The operation of the circuit in FIG. 3 at a high level is illustrated in FIG. 4. The process 400 involves the security guard pressing the CLOSE switch in operation 402. Next, the controller determines if a vehicle is present over/under the barrier, and if so, then in operation 406 the operator must wait for the vehicle to pass. After the vehicle passes, the security guard can press the CLOSE switch again at operation 402.

Assuming that a vehicle is not present in the barrier path, then in operation 408 power is provided to the activation relay 314. The activation relay closes providing power to the latching relay in operation 410. If the state of the latching relay at operation 412 is such that it is reset (e.g., closed), then power is provided at operation 414 to provide power to the directional valve to raise the barrier. The barrier is raised at operation 420 and the process is completed at operation 423. If the state of the latching relay at operation 412 is that it is latched (e.g., open), then no power is provided to the directional valve, and the latching relay must be reset by one of two ways. First, the operator can press the OPEN switch at operation 416. Alternatively, the controller can detect passage of the vehicle at operation 425 and activates the automatic reset relay 374 at operation 418. Either approach resets the latch in operation 418, so that the barrier may now be raised when the CLOSE switch is pressed at operation 402.

A more detailed explanation of the operation of the circuit of FIG. 3 is now provided. As noted previously, closing the barrier first requires pressing the OPEN switch. Referring back to FIG. 3, when the open switch 350 is pressed, power is presented to the sallyport interlock relay. A sallyport is a secure entrance arrangement, typically with two sets of doors or controlled access points. After gaining entrance past the first access point, a second controlled access point is encountered. This allows, for example, one vehicle at a time to enter a facility. Usually, when the first access point is opened, the second access point is closed. Although the sallyport interlock is not required in all embodiments, it may be present in some.

Assuming the sallyport interlock is normally closed, any power presented to the sallyport interlock relay 352 will be passed to the relay contacts 354, which are also normally closed. These contacts 354, designated as 1CR, are controlled by coil 212 of relay 370, also designated as 1CR. Relay 370 is a double pole relay and is energized when the OPEN switch 350 is pressed and throws contacts 214 and 354 simultaneously. The diagram of FIG. 3 does not readily allow contacts 354 to be shown adjacent to the coil 356 with a dotted line as with the other relays. Thus, if coil 212 is not energized, then contacts 354 are closed. Power is then provided to coil CR 356. This relay is activated whenever the OPEN switch is pressed, opening the contacts 208. Thus, whenever the OPEN switch is activated, the circuit for closing the barrier is opened. This avoids any possibility of activating both the open and close circuits simultaneously.

At the same time, power is presented to the reset coil 326 of the latching relay 320 from the interconnection point 355. This resets the contacts 322 of the latching relay 320 to the normal state, which is a closed state. This prepares the latching relay for future closing of the barrier. The reset coil 326 can also be energized by receiving power from the automatic reset relay 374. When the last authorized vehicle passes, the controller 309 can detect this via a road sensor and send signals to coil 372 thus closing the contacts 376. This automatic detection of vehicles which have passed through the checkpoint causes the reset coil to reset the latching relay. In this manner, there is no need for the operator to manually reset the latching relay by pressing the OPEN switch twice.

At this point, the barrier can be closed by pressing the CLOSE switch 204. Pressing the CLOSE switch 204 provides power from the power source 202 to the contact 308*a* and then to 308*b* (collectively referred to as 308) of the vehicle detection relay. If no vehicle is present, the contacts 308 are normally closed, and power passes through to the first contact 208*a* of relay 370 and then to the second contact 208*b*. These contacts are normally closed as well. Recall that this relay 370 is energized and the contacts are opened when the OPEN switch 350 is pressed. Since the OPEN switch is not presently being pressed, the contacts remain closed. Power is then provided to the coil 212 of relay 222. Coil 212 then closes contacts 214, which are otherwise normally open.

Closing the contacts 214 of the activation relay 222 then provides power to the activation relay switch contacts 322*a* and 322*b* (collectively called 322) of the latching relay 320. In the prior art, power from the hydraulic activation relay would be provided directly to the directional valve 232, but the latching relay provides an additional series switch. Because the latching relay 320 was previously reset by pressing the OPEN switch 350, the latching relay 320 is in its normally closed state. Thus, power passes through the contacts 322 to the directional valve 232, and the barrier is raised.

With the barrier raised, vehicles are restricted from passing through the checkpoint. Assuming that a vehicle is sensed as being in the checkpoint (e.g., in the path of the barrier's movement) by the controller 309, this will cause the controller to activate relay 306, which in turn will change the contacts 310 from a normally open state to a closed state. This will provide power from the voltage source 204 to the latch coil 324 of the latching relay 320. This causes the latching relay 320 to latch, so that the contacts 322 are now set to the open position. Thus, the operator cannot accidentally raise the barrier into the vehicle.

Assume that the vehicle is authorized to pass, and the guard can lower the barrier by pressing the OPEN switch 350, and the cycle begins again. Note that once a vehicle is detected in the path of the barrier, the latching relay 320 is set so that the contacts are opened. Thus, pressing the CLOSE switch at this point will not raise the barrier. To raise the barrier, the OPEN switch can be activated to reset the latching relay 320, even though the barrier is already in the open position. This operation means that if a vehicle is authorized to pass, and the barrier is down, the barrier cannot accidentally raise as the vehicle passes. This circuit prevents accidental closure of the barrier, which can occur if the contacts 214 of the hydraulic valve activation relay 222 inadvertently make contact. Once the vehicle is safely past the checkpoint, the controller can automatically reset the latching relay using the auto reset relay 374.

Figure 5A:
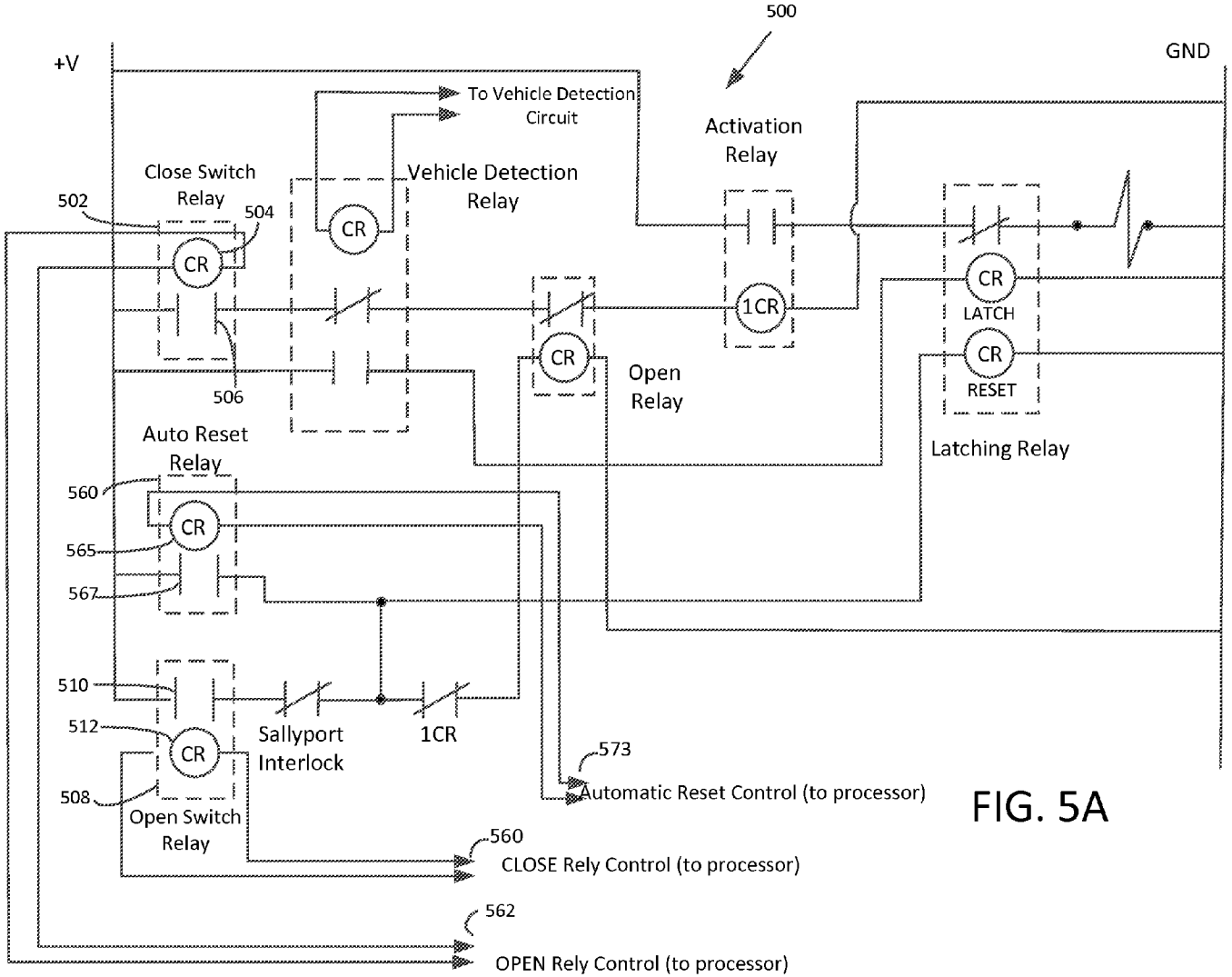
FIGS. 5A-5B illustrate another embodiment of a fail-safe control system for controlling a barrier using a computer, according to various embodiments described herein.
Figure 5B:
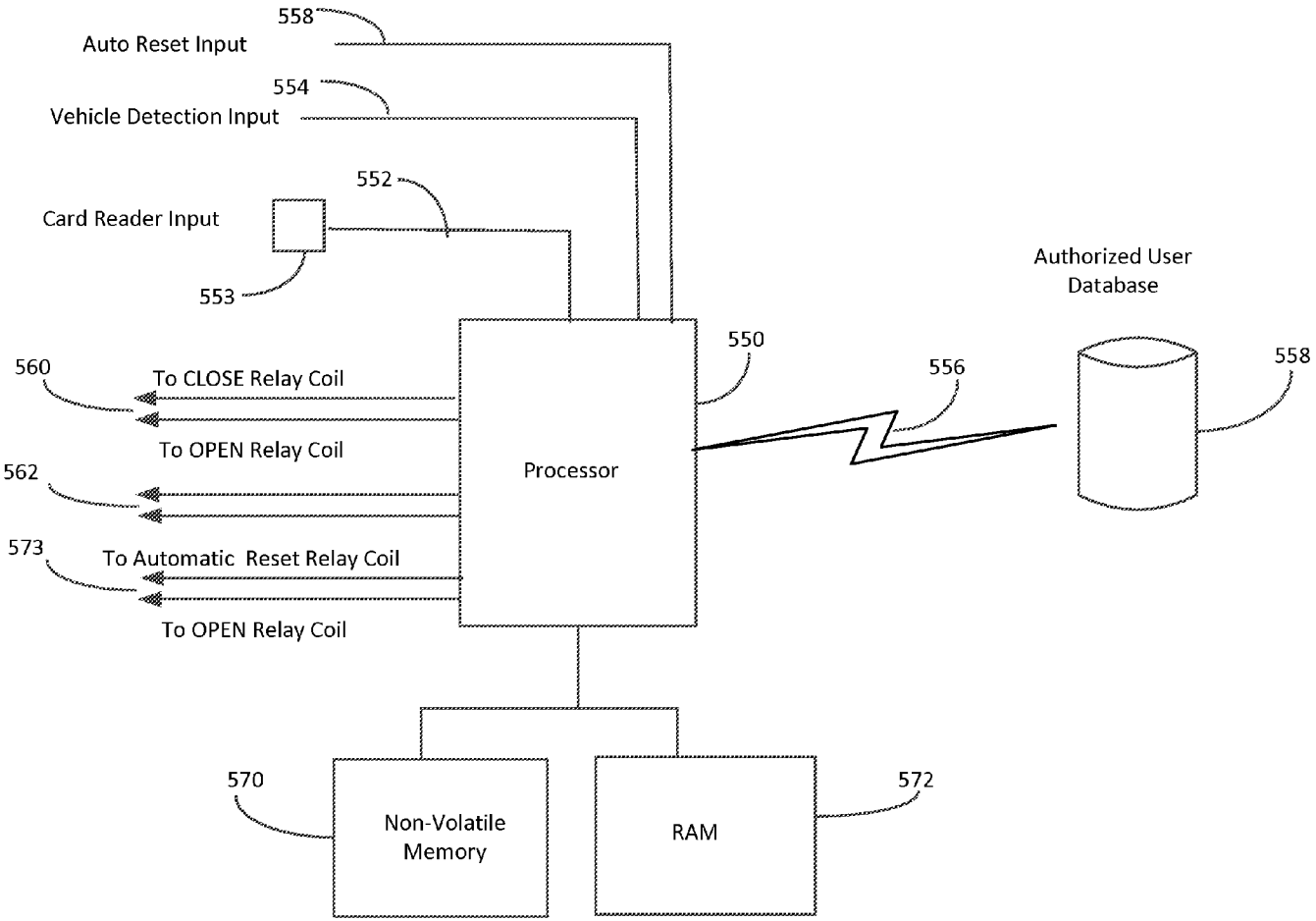

Another embodiment of the circuit of FIG. 3 is shown in FIGS. 5A and 5B. In this embodiment, the manually operated CLOSE switch 204 and the OPEN switch 350 of FIG. 3 are replaced with relays which are controlled by a processor. This embodiment can be used in automated checkpoints, such as in installations where a card reader is used to gain entry to a parking facility and there is no security guard. In this type of embodiment, the barrier may be merely a gate or a control arm that is raised or lowered to allow a vehicle to pass. Nevertheless, the principles of the present invention can be applied so as prevent the gate from damaging the vehicle as it passes through the entry point and automatically resetting the latching relay after a vehicle passes.

Turning to FIG. 5A, the Close switch relay 502 comprises a coil 504 and switch contacts 506. The switch contacts are functionally equivalent to the CLOSE switch 204 of FIG. 3. The switch contacts 506 are activated when the coil 504 is energized, which is controlled by a processor. The coil 504 has leads 560 which go to the processor 550 (see FIG. 5B). Similarly, Open Switch relay 508 comprises a coil 512 and contacts 510. The Open Switch relay contacts 510 are functionally equivalent to the OPEN switch 350 of FIG. 3. The contacts 510 close when the coil 512 is energized, which is also controlled by the processor 550 via control leads 562. Thus, activation of the Close switch relay 502 and the Open switch relay 508 is controlled by a processor executing a program, as opposed to under the control of a security guard. The automatic reset relay 374 is shown, comprising its coil 372 and contacts 376. The coil 374 is controlled using leads 573, which are connected to the processor. The other components are as previously described.

The processor 550 is shown in FIG. 5B, and is electrically connected to the Close relay coil leads 560, the Open relay coil leads 562, and the Automatic Reset Relay Coil 573. The processor 550 also receives input from a device capable of providing user identification information 552. Typically, this is in the form of a card reader 553 located near the entrance. Other devices, such as keypads, RFID sensors, etc. can be used. The input is processed by the processor to ascertain whether the driver is authorized to enter. Typically, a database 558 of authorized users is accessed, often via a network or other type of communication connection 556. The processor may also have an input 554 which indicates whether a vehicle is in the path of the control arm or gate. Finally, the processor may access non-volatile memory 570 and RAM memory 572, which are forms of computer readable media storage devices that provide non-transitory signals for program data and that can be used for data storage. Either type of memory may store computer control instructions that when executed by the processor cause it to control the Open relay coil, the Close relay coil, and the Automatic Reset relay coil as described herein.

In one embodiment, the processor executes instructions causing it to receive input from the card reader providing information about a driver requesting entry to the facility. The processor ascertains whether the information provided corresponds to an authorized entrant. This could involve accessing a database, for example, of currently authorized users. Upon receiving an indication that the driver is authorized, the processor then authorizes passage of the vehicle by first causing the Open relay coil to be energized. This causes the barrier to move to allow passage, and as previously described, this causes the latching relay to reset. In some embodiments, rather than the barrier lowering, the barrier (such as a control arm) may raise to allow the vehicle to pass. The vehicle can then pass and as it does so, it is detected by the processor and this causes the automatic reset relay to activate, and causes the latching relay to be reset.

After a fixed amount of time, or based input from other sensors detecting the passage of the vehicle through the gate, the processor can then cause the barrier to close the entrance. In order for the processor to activate or close the barrier, the Open switch relay coil 510 can be first energized causing the latching relay to reset if the processor has not reset the latching relay using the Automatic Reset relay. Once reset, the processor can then energize the Close switch relay coil 504 which causes the barrier to close the entrance. In this manner, it is possible for the processor to execute a program stored in memory to perform similar functions as a security guard would in controlling access at the checkpoint.

The subject matter described herein is provided by way of illustration only and should not be construed as limiting. The embodiments described herein are illustrated using mechanical relays. Those skilled in the art will recognize that the principles disclosed herein can be applied to other applications using other types of devices, including solid state relays, transistors, and other types of solid state devices in lieu of the components described herein. Further, alternate embodiments of the circuit and circuit configurations are possible. Various modifications and changes may be made to the subject matter described herein without exactly following the example embodiments and applications illustrated and described, and without departing from the true spirit and scope of the present disclosure, which is set forth in the following claims.

What is claimed is:

1. A vehicle barrier security system for controlling a barrier at a security checkpoint comprising:

a power source providing power;

a CLOSE switch connected to the power source and configured to provide power from the power source to raise the barrier when the CLOSE switch is activated;

a vehicle detection relay configured to receive the power from the CLOSE switch at a first contact of the vehicle detection relay and provide the power to a second contact of the vehicle detection relay when a vehicle is not detected at the checkpoint;

an actuation relay comprising an actuation relay coil, the actuation relay configured to receive the power from the second contact of the vehicle detection relay thereby energizing the actuation relay coil and providing the power from a first contact of the actuation relay to a second contact of the actuation relay;

a latching relay connected in series with the second contact of the actuation relay and configurable to be in a latched state or a reset state, wherein the latching relay is configured to receive the power from the second contact of the actuation relay at a first contact of the latching relay and provide the power from the first contact of the latching relay to a second contact of the latching relay when the latching relay is in the reset state;

an actuation mechanism electrically connected to the second contact of the latching relay and configured to raise the barrier when:

the actuation relay provides the power to the second contact of the actuation relay, when the latching relay is in the reset state, and when the power is provided from the first contact of the latching relay to the second contact of the latching relay thereby providing power to the actuation mechanism; and an automatic reset relay configured to receive power at a first contact of the automatic reset relay and provide power to a second contact of the automatic reset relay when energized, thereby providing power to a reset coil of the latching relay and resetting the latching relay.

2. The system of claim 1, wherein the vehicle detection relay is configured to provide the power to a latch coil of the latching relay to latch the relay when a vehicle is detected.

3. The system of claim 1, further comprising an OPEN switch configured to provide power to the reset coil of the latching relay.

4. The system of claim 1, wherein the automatic reset relay coil is energized in response to detecting passage of a vehicle past the security checkpoint.

5. The system of claim 1, wherein the vehicle detection relay is configured to be in an open condition when the vehicle is detected at the checkpoint.

6. The system of claim 5, wherein the barrier comprises a plurality of bollards.

7. The system of claim 1, wherein detection of a vehicle uses a buried wire in a road to detect the presence of the vehicle on the road.

8. The system of claim 5, wherein the vehicle detection relay comprises a double pole relay.

9. A system for avoiding inadvertent positioning of a barrier at a checkpoint in a vehicle barrier control system, comprising:

a power source;

an input switch configured to be activated by a user thereby generating a signal to raise the barrier;

an actuation mechanism configured to raise or lower the barrier, the actuation mechanism configured to raise the barrier when receiving power to raise the barrier;

a first vehicle sensor detecting the presence of a vehicle at a checkpoint;

a second vehicle sensor detecting the passage of the vehicle past the checkpoint;

a controller generating a second signal indicating the presence of the vehicle detected by the first vehicle sensor, the controller using the second vehicle sensor to generate a third signal indicating the passage of the vehicle;

a first switch in a normally closed state and configured to be opened when receiving the second signal indicating the presence of the vehicle;

a second switch in a normally opened state and configured to be closed when the input switch generates the signal to raise the barrier;

a latching switch having a reset state wherein the latching switch is closed, the latching switch also having a latched state wherein the latching switch is open, wherein the input switch and the first switch are connected in series to provide the signal to the second switch, thereby providing power from the power source through both the second switch and the latching switch to the actuation mechanism to raise the barrier when:

the input switch generates the signal to raise the barrier, there is no second signal indicating the presence of the vehicle detected by the vehicle sensor, and the latching switch is reset; and an automatic reset relay configured to receive the third signal from the controller and provide power to put the latching switch in a reset state.

10. The system of claim 9, wherein the latching switch comprises a latch coil that when energized puts the latching switch in a latched state, and a reset coil that when energized puts the latching switch in a reset state.

11. The system of claim 10, wherein the latching switch is reset in response to an OPEN switch being pressed.

12. The system of claim 11, wherein pressing the OPEN switch causes the actuation mechanism to lower the barrier.

13. The system of claim 12, wherein the power source comprises a 24 volt power source.

14. The system of claim 13, wherein the first switch and the second switch comprise a relay switch.

15. The system of claim 14, wherein the first switch comprises a double pole relay.

16. A method of controlling movement of a barrier in a vehicle barrier security system, the method comprising:

detecting passage of a vehicle past a checkpoint;

generating a signal to an automatic reset relay thereby causing power to be providing to a latching switch, wherein the latching switch is placed into a reset state;

receiving input from a user at a switch for raising the barrier at the checkpoint thereby generating a first signal;

receiving a second signal at a second switch in a normally closed state, wherein the second signal indicates the absence of a vehicle over the barrier;

receiving the first signal at a third switch in a normally open state thereby closing the third switch;

providing power from a power source through the third switch in response to closing the third switch;

providing the power from the third switch to the latching switch, wherein the latching switch is in a normally closed state when in a reset state, and the latching switch is in the reset state; and providing the power from the latching switch to an actuation mechanism causing the barrier to rise.

17. The method of claim 16, further comprising:

changing the state of the second switch from a normally closed state to an open state; and energizing a latch coil of the latching switch based on changing the state of the second switch.

18. The method of claim 17, further comprising:

receiving input from the user at an OPEN switch for lowering the barrier at the checkpoint thereby providing power to a reset coil of the latching switch and changing the state of the latching switch to the normally closed state.

19. The method of claim 17, generating a signal to an automatic reset relay thereby causing power to be providing to a reset coil of the latching switch.

20. A non-transitory computer readable medium storage device comprising instructions which when executed cause a computer to:

receive a first input signal from a sensor associated with a vehicle barrier at a checkpoint for receiving a request from a user to open a barrier at a checkpoint;

ascertain using the first input signal that the user authorized to pass the checkpoint;

receive a second signal input wherein the second signal indicates the absence of a vehicle over or under the barrier;

provide a third signal to an activation switch in a normally open state thereby closing the activation switch, thereby providing power from a power source through the activation switch in response to closing the activation switch, thereby providing power from the activation switch to a latching switch, wherein the latching switch is in a normally closed state when in a reset state, and the latching switch is in the reset state, and thereby providing the power from the latching switch to an actuation mechanism causing the barrier to move so as to allow entry of the vehicle;

detecting the passage of the vehicle past the barrier at the checkpoint; and generating a fourth signal to the latching switch in response to detecting the passage of the vehicle, wherein the latching switch is reset to a normally closed state.

* * * * *